US007017963B1

(12) United States Patent
Setzke et al.

(10) Patent No.: US 7,017,963 B1
(45) Date of Patent: Mar. 28, 2006

(54) COUNTER WEIGHTED LIFTING BEAM

(75) Inventors: William Setzke, Monee, IL (US); Cloyd R. Selby, Lockport, IL (US)

(73) Assignee: Selby Arm, Inc., Bourbonnais, IL (US)

( * ) Notice: Subject to any disclaimer, the term of this patent is extended or adjusted under 35 U.S.C. 154(b) by 0 days.

(21) Appl. No.: 10/848,341

(22) Filed: May 17, 2004

(51) Int. Cl.
*B66C 1/00* (2006.01)

(52) U.S. Cl. ..... 294/81.3; 294/67.5

(58) Field of Classification Search ..... 294/81.3, 294/81.56, 67.5, 67.21, 67.22, 81.5; 414/10; 212/196
See application file for complete search history.

(56) References Cited

U.S. PATENT DOCUMENTS

| | | | | |
|---|---|---|---|---|
| 2,246,142 | A | 6/1941 | Moore | |
| 3,451,224 | A | 6/1969 | Colechia et al. | |
| 3,552,793 | A | 1/1971 | Lehtonen | |
| 3,572,803 | A | 3/1971 | Pompe | |
| 3,675,960 | A * | 7/1972 | Mangold | 294/81.3 |
| 3,675,961 | A | 7/1972 | Wheeler | |
| 3,762,755 | A | 10/1973 | Saether | |
| 4,017,019 | A | 4/1977 | Booth | |
| 4,017,109 | A | 4/1977 | Belinsky | |
| 4,245,941 | A | 1/1981 | Charonnat | |
| 4,251,098 | A | 2/1981 | Bellinsky | |
| 4,355,832 | A | 10/1982 | Anderson | |
| 4,418,953 | A | 12/1983 | Dunbar | |
| 4,425,941 | A | 1/1984 | Weaver | |
| 4,451,198 | A | 5/1984 | Sanderson | |
| 4,626,012 | A | 12/1986 | Weldele | |
| 4,671,721 | A | 6/1987 | Pratt et al. | |
| 4,759,674 | A | 7/1988 | Schroder et al. | |
| 5,312,218 | A | 5/1994 | Pratt et al. | |
| 5,355,832 | A | 10/1994 | Loh et al. | |
| 6,048,012 | A * | 4/2000 | Selby et al. | 294/81.3 |
| 6,578,892 | B1 * | 6/2003 | Tsimmerman | 294/67.21 |

FOREIGN PATENT DOCUMENTS

| | | | |
|---|---|---|---|
| DE | 266339 | | 10/1882 |
| DE | 24 52 345 | | 5/1976 |
| DE | 266-339 | A | 3/1989 |
| FR | 2551738 | * | 3/1985 |
| JP | 352033244 | A * | 3/1977 |
| RU | 969638 | | 9/1910 |
| RU | 1512908 | | 10/1924 |
| RU | SU-969-638 | | 5/1982 |
| RU | 992383 | | 1/1983 |
| RU | SU-992-383 | | 5/1983 |
| RU | SU 1512-908 | A | 7/1989 |

* cited by examiner

*Primary Examiner*—Kathy Matecki
*Assistant Examiner*—Esther O. Okezie
(74) *Attorney, Agent, or Firm*—Barnes & Thornburg LLP

(57) ABSTRACT

A counterbalanced lifting beam designed to lift and permit balancing of heavy loads. The lifting beam includes an internal counterweight that is adapted to be hydraulically adjusted by use of a manually operated control mechanism. The lifting beam also includes a rigid elongated lifting tower to add stability to the lifting beam and includes a centralized storage cabinet, which stores control mechanism and increases the weight concentration and the overall stability of the beam. Storage batteries and hydraulic control equipment are fully encased in the storage cabinet. As the lifting beam is held by the crane cable and a swivel, the beam can be moved in three dimensions.

19 Claims, 3 Drawing Sheets

10
14
21
24
63
60
64
50
16
40
32
34
38
28
21
30
36
19
54
77
20
26
2A
2A
42
12
56
15
74
76
58

COUNTER WEIGHTED LIFTING BEAM

BACKGROUND

This invention is designed to provide an apparatus to be used primarily in conjunction with a crane in situations requiring a load, be it materials, equipment or otherwise, to be inserted into a portal or under an obstruction by the use of an elongated boom. Oftentimes, during construction, it is necessary to place materials in elevated locations without the aid of an attached loading platform. This necessitates the use of hooks and ropes to position the load and manually pull it through an opening, usually a vacant window opening. This function can be dangerous to both the employees and to the load, especially when the task is at great heights. Prior art lifting beams, as shown in U.S. Pat. No. 6,048,012, utilizing a counterweight to offset the weight of the load require continuous counterweight adjustment, during load transfer, in order to prevent unwanted shifting of the load.

In view of the above, it should be appreciated that there is a need for a lifting beam that permits loads of various weights to be transferred from a ground level to an elevated level and through an opening in a building without the requirement of undue counterweight adjustment while the transfer is occurring. The present disclosure satisfies these and other needs and provides further related advantages.

SUMMARY

The present invention is directed to a counterbalanced lifting beam having a centralized weight concentration that is designed to lift and permit balancing of heavy loads. The lifting beam includes an internal counterweight that is adapted to be hydraulically adjusted by use of a manually operated control mechanism. The lifting beam also includes a rigid elongated lifting tower that increases the stability of the lifting beam and includes a centralized storage cabinet, which stores control mechanism and increases the weight concentration and promotes the overall stability of the beam. Storage batteries and hydraulic control equipment are fully encased in the storage cabinet. As the lifting beam is held by the crane cable and a swivel, the beam can be moved in three dimensions.

Other features and advantages of the disclosure will be set forth in part in the description which follows and the accompanying drawings, wherein the embodiments of the disclosure are described and shown, and in part will become apparent upon examination of the following detailed description taken in conjunction with the accompanying drawings.

DETAILED DESCRIPTION

Figure 1:
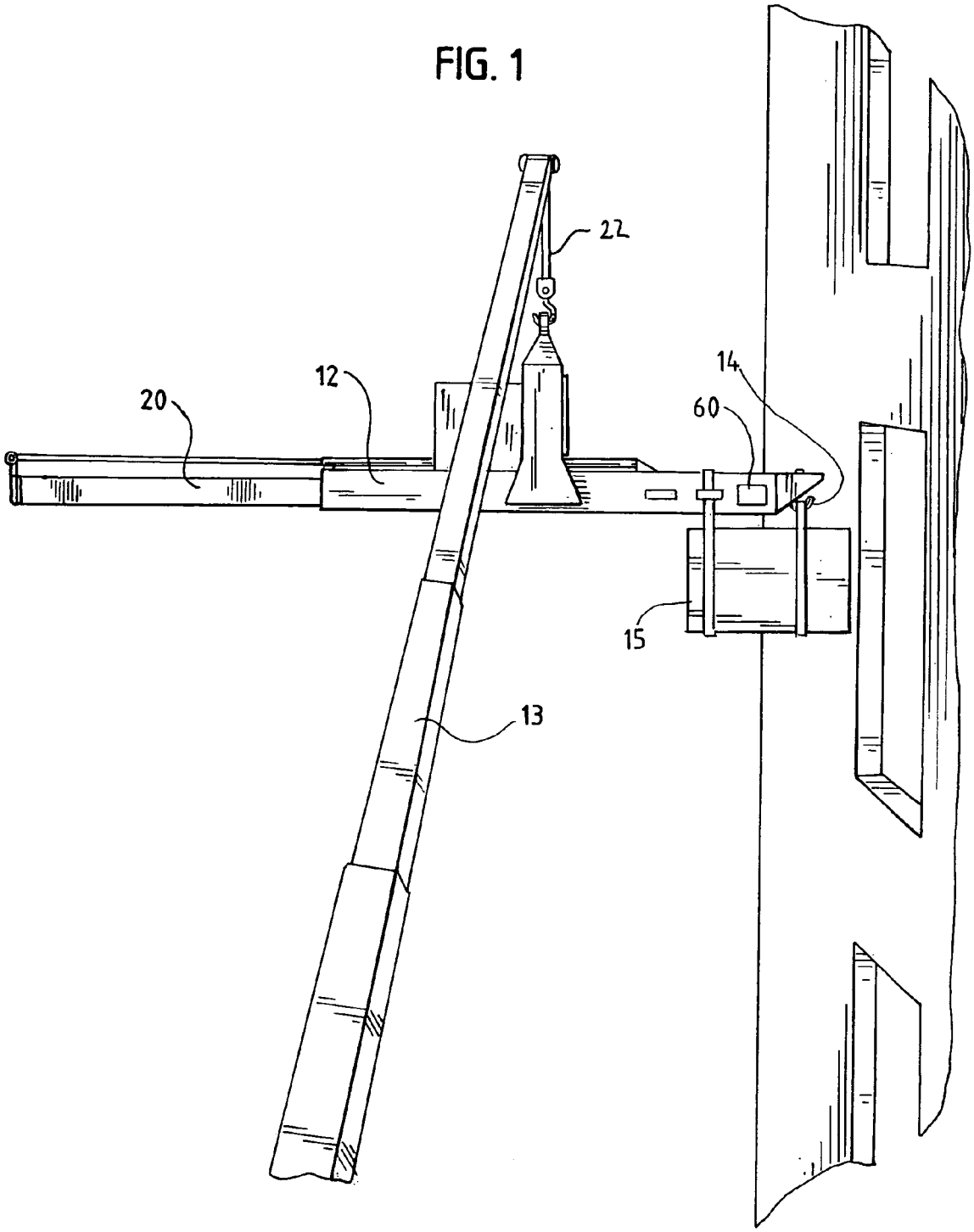
FIG. 1 is a perspective view of the preferred embodiment of the lifting beam attached to a crane.

As illustrated in the drawings, the present invention relates to a lifting beam 10 which is adapted to be connected to a crane 13 and is designed to permit an operator to quickly level the beam 10 after a load 15 has been secured thereto as shown in FIG. 1. The use of the lifting beam 10 permits quick and easy transportation of a load from the ground to a location elevated from the surface below. The lifting beam, generally designated with the numeral 10, includes a housing member 12, a load securing member 14, a rigid elongated lifting tower 16, a hydraulic system, a centralized storage cabinet 19 and a counterweight 20. The lifting beam 10 is designed to be connected to a crane cable 22 of the crane 13.

Figures 2, 2A, 3:
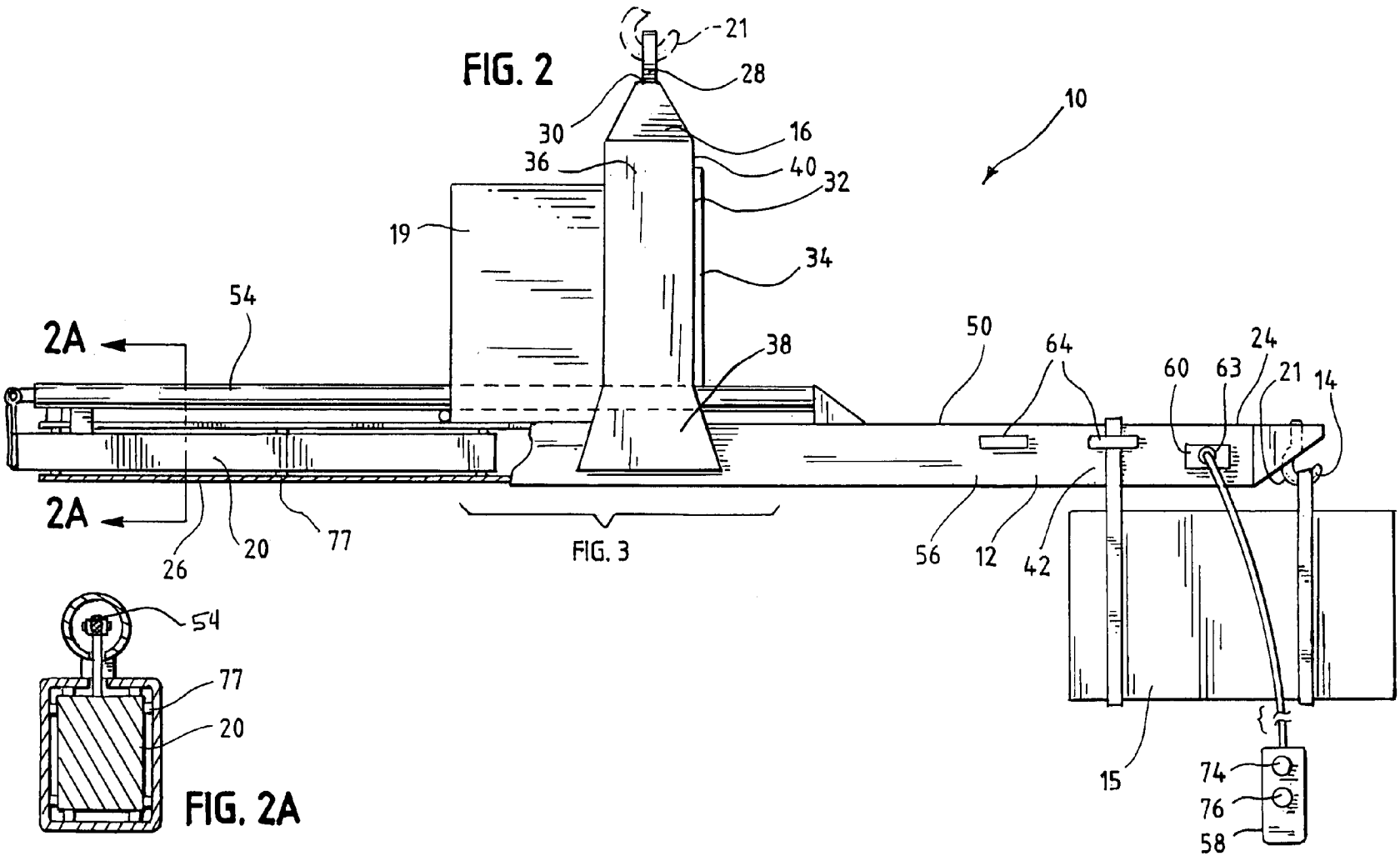
FIG. 2 is a perspective view in phantom of the lifting beam of FIG. 1, illustrating the relative relationship between the internal components of the lifting beam, particularly the hydraulic cylinder and the internal counterweight.
FIG. 2*a* is a cross sectional view of the lifting beam of FIG. 1 taken along lines 2*a*–2*a* in FIG. 2.
FIG. 3 is a perspective view in phantom illustrating the centralized storage cabinet.
Figure 3:
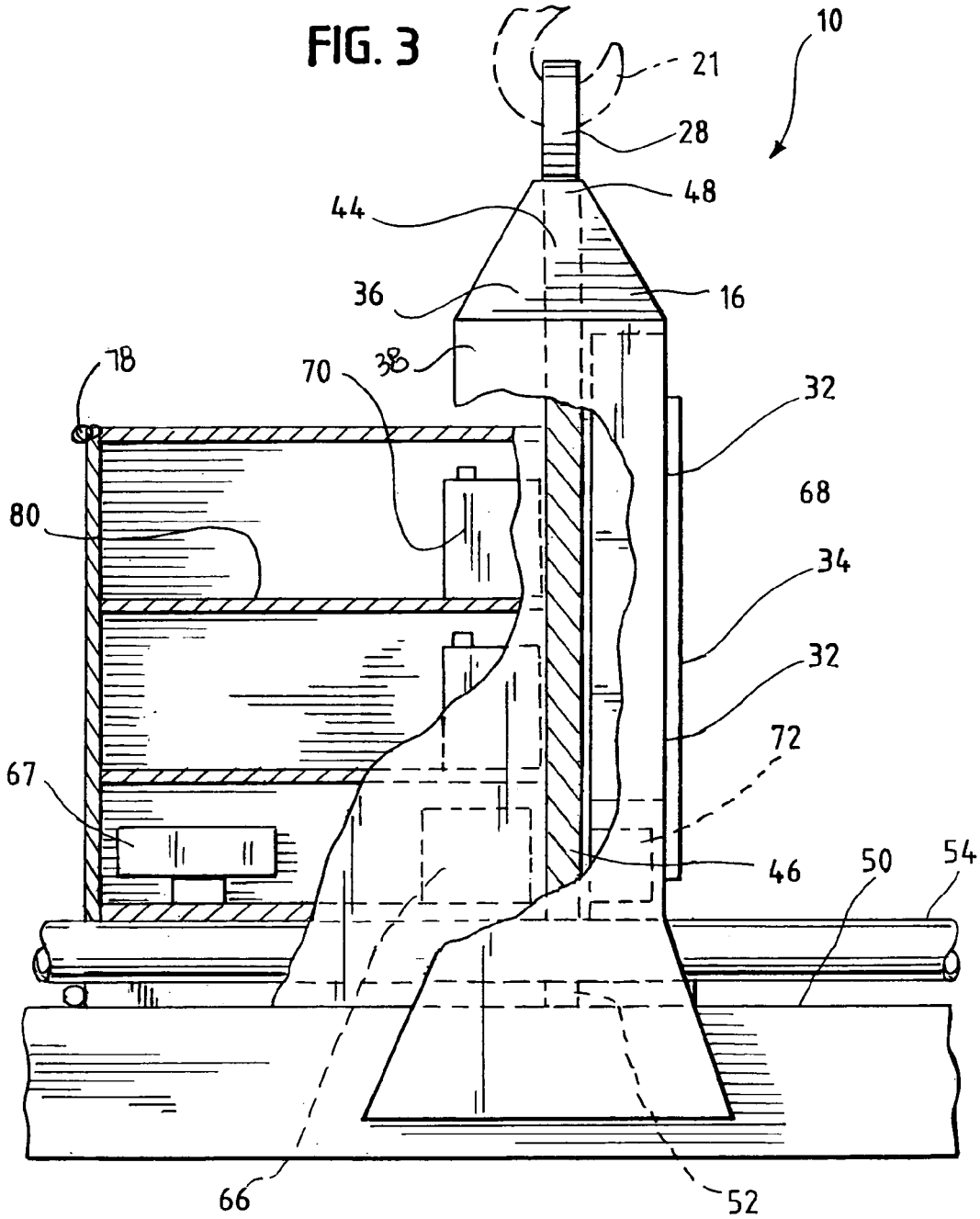

The housing member 12, as shown in FIG. 2, includes a heavy gauge steel housing welded to form a tube. The housing member 12 includes a first end 24 adapted to receive the load 15 and a second end 26 that permits extension of the counterweight 20. The lifting tower 16 is rigidly secured to the housing member 12 along its center of gravity and provides for an eyelet 28 at the top end 30 of the lifting tower 16. The lifting tower 16 is preferably welded to the housing member 12 but other securing means may also be employed including bolting or riveting.

The lifting tower 16 includes a forward surface 32 that acts as a stop to prevent the lifting beam 10 from being inserted too far into the building, preventing damage to the crane cable 22. The forward surface 32 includes a pad 34 that acts as a cushion in the event the lifting tower 16 contacts the building structure, to prevent marring of the building's facade. The lifting tower 16 is rigidly secured to the housing member 12 to increase the stability of the lifting beam 10 and is designed to provide a pocket 36 to permit placement of the centralized storage cabinet 19. The lifting tower 16 is comprised of first and second side plates 38, 40 that are connected to sides 42 of the housing member 12. The lifting tower 16 includes a bridge plate 44 that interconnects the first and second side plates 38, 40 to form an I-beam arrangement and includes a first end 46 and a spaced apart second end 48 as shown in FIG. 3. The first end 46 of the bridge plate 44 is connected to a top surface 50 of the housing member 12 and includes an opening 52 therein to permit the passage of a hydraulic cylinder 54. The second end 48 of the bridge plate 44 is connected to the eyelet 28.

The eyelet 28 is adapted to be connected to a hook 21 on the crane cable 22, as shown in FIG. 2. Since the eyelet 28 is spaced a considerable distance from the housing member 12, the stability of the lifting beam 10 is increased by increasing the moment force that needs to be applied to the lifting beam 10 in order to offset the balance of the beam. Enhanced stability is also due to the I-beam design of the lifting tower 16. Stability is further increased because of the lifting beams attachment to the top surface 50 and sides 42 of the housing member 12. The use of the lifting tower 16 eliminates the need for an automatic balancing system that would constantly adjust the counterweight 20 to prevent undesirable tipping of the load. Once the lifting beam 10 is initially balanced by the operator, there is no longer a need for continuous counterweight adjustment while the beam is being elevated from the ground.

The use of the lifting tower 16 also permits the housing member 12 of the lifting beam 10 to be inserted further into the building structure, exceeding the range of a lifting beam in combination with a triangular harness and hook arrangement as illustrated in U.S. Pat. No. 6,048,012. Use of the triangular harness limits insertion of the housing member 12 into the building.

The load securing member 14, shown in the preferred embodiment as a swivel hook 21, is attached to the first end 24 of the housing member 12, as shown in FIG. 2. A chamber 56 is defined within the housing member 12 and extends the length of the housing member 12. The counterweight 20, which is connected to the hydraulic cylinder 54, is slidably disposed within the chamber 56 and adapted to move axially in response to the change in the angular orientation of the housing member 12, as controlled by the operator. The counterweight 20 can partially extend outside the second end 26 of the housing member 12 to a distance to sufficiently balance the load attached to the first end 24 of the housing member 12.

The preferred method of use of the lifting beam 10 involves a cooperative effort between the crane operator and the lifting beam operator. The eyelet 28 of the lifting tower 16 of the lifting beam 10, is attached to the crane 13 by means of a swivel hook, that is placed through the eyelet 28. After the housing member 12 has been initially lifted off of the ground, the lifting beam operator removes the control cable unit 58, as seen in FIG. 2, from a central cable stowage box 60 and directs the crane operator to position the housing member 12 over the load 15. It is known that the load 15 can be attached to the housing member 12 in one of two ways. The preferred method, is to have the load 15 strapped or secured by a suitable means to the load securing member 14 at the first end 24 of the housing member 12.

The alternative method is to wrap a sling or other strapping material around the housing member 12, also at the first end 24 of the housing member 12, and utilize a set of guide loops 64 positioned along the sides 42 of the housing member 12, as shown in FIG. 2, to insure the load securing straps remain in place and do not slide off of the housing member 12. The advantage of using the load securing member 14 to attach the load 15 to the first end 24 of the housing member 12 is that the load 15 can be rotated in the horizontal plane while the strapping wrapped around the housing member 12 is fixed with only minimal movement in the horizontal plane.

Once the lifting beam 10 is attached to the crane and the load 15 is attached to the housing member 12, the crane picks up the lifting beam 10 by slowly raising the crane cable 22. Initially, as the lifting beam 10 is slowly raised, the housing member 12 will not be horizontally oriented due to the load 15 at the first end 24 of the housing member 12. To level the housing member 12, the operator depresses the extend button 74 on the control cable unit 58, which energizes the hydraulic system, extending the hydraulic cylinder 54 and extending the counterweight 20 from the second end 26 of the housing member 12. Movement of the counterweight 20 in a direction opposite the load balances the overall weight of the beam and load at the fulcrum, returning the housing member 12 to a horizontal position. Due to the increased stability caused by the rigidly attached lifting tower 16 continual adjustments of the counterweight 20 are not required. The operator, with use of the cable unit 58 has the ability to reposition the load 15 to compensate for wind load and to raise or lower the load 15 for entry through an opening in a building structure.

The hydraulic system used to extend and retract the hydraulic cylinder 54 includes a hydraulic pump 66, a reservoir 68 for storing hydraulic fluid, electric power supply 70, solenoid valve 67 and the hydraulic cylinder 54, best illustrated in FIG. 3. Although a hydraulic system is shown, it is known that other similar type of arrangements for axially moving large masses can also be used, including, but not limited to, a rotary screw assembly, rack and pinion and other devices well known to those skilled in the art. The hydraulic pump 66 and the reservoir 68 are positioned adjacent to the lifting tower 16 within the storage cabinet 19.

In response to an unbalanced load, the control cable unit 58 is used by the operator to activate the hydraulic system. The power source for the hydraulic system consists of batteries 70 with an on-board charger 72. A gasoline engine also may also be used. The storage batteries 70 and the charger 72 are positioned within the storage cabinet 19, adjacent to the lifting tower 16 to center the load on the beam. The positioning of the batteries 70, charger 72 and pump 66 in the storage cabinet 19 adjacent to the lifting tower 16 concentrates the weight of the lifting beam 10 near the center adding stability eliminating the need for constant adjustment of the counterweight 20.

The storage cabinet 19 is positioned upon the housing member 12 and adjacent to the lifting tower 16. The storage cabinet 19 includes a hinge 78 that permits the storage cabinet 19 to be tilted to an open position to access the batteries, 70, charger 72, or hydraulic pump 66 within the cabinet 19. The oil reservoir 68 is located inside of the lifting tower 16 to further concentrate the load at the center of gravity of the beam. The storage cabinet 19 includes shelving units 80 that permit vertical stacking of the various accessories to further concentrate the equipment load adjacent to the lifting tower 16. The storage cabinet 19 also permits the storage of the hydraulic directional valve, the electrical disconnect and additional storage for tools and rigging.

Figure 4:
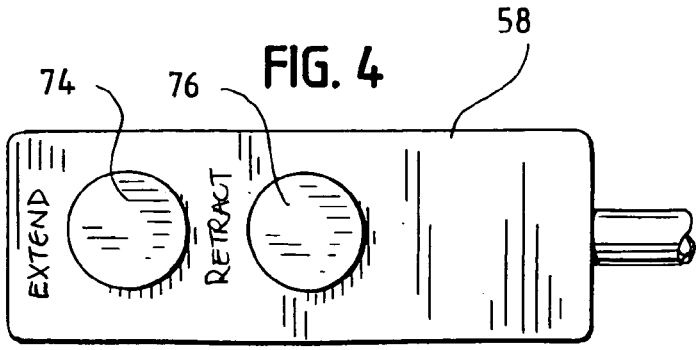
FIG. 4 is a top view of the control cable unit.

The beam operator uses the control cable unit 58 to initially level the housing member 12 by pressing the extend button 74, as shown in FIG. 4 which electrically activates the internal motor of the hydraulic pump 66, which in turn axially displaces the hydraulic cylinder 54. The counterweight 20, which is connected to the hydraulic cylinder 54, is equally displaced axially away from the first end 24 of the housing member 12 until the housing member 12 is once again horizontally level.

With the load 15 attached to the first end 24 of the housing member 12, the housing member 12 and attached load 15 is further lifted by the crane operator to eventually be delivered to the desired location. To ease in the axial displacement of the counterweight 20, a series of rollers or wear pads 77 are provided along the inner walls of the housing member 12, to enable the counterweight 20 to move easily and not to impinge on the sides, top or bottom of the housing member 12, as shown in FIG. 2.

Once the housing member 12 and attached load 15 reaches the desired location, the first end 24 of the housing member 12 with the attached load 15 are inserted through an opening in a building to place the load 15 on a desired floor. Once the load is inserted through the opening in the building, the beam operator removes the control cable unit 58 and pushes the retract button 76, thereby axially displacing the counterweight 20 towards the first end 24 of the housing member 12 until there is sufficient slack in the securing device to release the load securing member 14 from the load 15.

Use of the cable unit 58 to control the lifting beam 10 relieves the responsibility of the crane operator, who is "blind" as to the final positioning of the load 15, to make any adjustments in the vertical direction. After the load 15 is disconnected from the first end 24 of the housing member 12, the beam operator utilizes the control cable unit 58 to manually raise the first end 24 until the housing member 12 has sufficient clearance to be safely removed. The beam operator then places the control cable unit 58 in the control cable storage box 60, and the crane operator backs out the housing member 12 from the opening in the building.

Removal of a load would be done in the opposite sequence as that shown and described for delivery of a load.

The lifting beam 10 can be designed for a wide range of loads and is sized to have the capability to balance loads attached to the beam. The lifting beam 10 saves substantial manpower, as only one operator is needed at both ends of the loading procedure, instead of multiple workers. In addition, there are increased safety effects of not having workers with pole hooks trying to physically pull the load 15 into the opening or under the structure. Finally, due to the balance of the lifting beam 10 caused by the rigid lifting tower 16 and concentrated load storage cabinet 19, constant adjustment of the counterweight 20 is not required during load transfer.

Various features of the invention have been particularly shown and described in connection with the illustrated embodiment of the invention. However, it must be understood that these particular arrangements merely illustrate, and that the invention is to be given its fullest interpretation within the terms of the appended claims.

What is claimed is:

1. A counterweighted lifting beam for raising a load from a first elevation to a second elevation when used with a hoisting mechanism, the lifting beam comprising:

an elongated housing member forming a beam having a first end and a second end, said housing member including a chamber;

a load securing member attached to said first end of said housing member, said load securing member adapted to permit attachment of the load;

a counterweight slidably disposed within said chamber;

a counterweight positioning mechanism adapted to vary the position of said counterweight within said housing member;

an elongated and vertically oriented lifting tower rigidly secured to the top and sides of said housing member approximately midway between said first end and said second end of said housing member, said lifting tower having a base portion and a top portion and at least one linear sidewall extending substantially the length of said lifting tower;

an attachment member secured to said top portion of said lifting tower, said attachment member adapted to permit attachment of said lifting tower to the hoisting mechanism;

a storage unit positioned adjacent a side of said lifting tower, opposite said first end and above said housing member, said storage unit adapted to store system components that operate said counterweight positioning mechanism, wherein the positioning of said storage unit and said system components proximate the midpoint of said lifting beam concentrates overall lifting beam mass at the midpoint of said beam, increasing overall lifting beam stability;

a control unit adapted to activate said counterweight positioning mechanism to vary the position of the counter weight with respect to said housing member to vary the angular inclination of the housing member.

2. The counterweighted lifting beam of claim 1, wherein said counterweight positioning mechanism includes a hydraulic cylinder connected to said counterweight, wherein said hydraulic cylinder is adapted to vary the position of said counterweight with respect to said housing member.

3. The counterweighted lifting beam of claim 1, wherein said lifting beam includes a means associated with said counterweight for assisting in the movement of said counterweight.

4. The counterweighted lifting beam of claim 1, further including at least one storage battery, positioned within said storage unit to provide power to said counterweight positioning mechanism.

5. The counterweighted lifting beam of claim 1, wherein said storage unit includes a housing to conceal the components of said counterweight positioning mechanism.

6. The counterweighted lifting beam of claim 4, further including a recharging apparatus for recharging said at least one storage battery.

7. A counterweighted lifting beam for raising a load from a first elevation to a second elevation when used with a hoisting mechanism, said lifting beam comprising:

an elongated beam having a first end and a second end, said elongated beam including a space therein defining a passageway;

a load securing member attached to said first end of said beam, said load securing member adapted to permit the attachment of the load to said first end of the beam;

a counterweight slidably disposed within the passageway of the beam;

a counterweight adjustment mechanism associated with said beam and adapted to vary the position of said counterweight within said passageway;

an elongated and substantially vertical lifting tower rigidly secured to the top and sides of said elongated beam approximately midway between said first end and said second end of said elongated beam;

a storage unit positioned adjacent a side of said lifting tower, opposite said first end and above said beam, said storage unit adapted to store system components that operate said counterweight adjustment mechanism, wherein the positioning of said storage unit and said system components proximate the midpoint of said lifting beam, concentrates overall lifting beam mass at the midpoint of said beam, increasing overall lifting beam stability;

an attachment member secured to a top portion of the lifting tower, the attachment member adapted to permit attachment to the hoisting mechanism;

a hydraulic control assembly adapted to control the movement of said hydraulic arm to vary the position of said counterweight with respect to said beam.

8. The counterweighted lifting beam of claim 7, wherein the counterweight adjustment mechanism includes a hydraulic pump and a hydraulic cylinder connected to said counterweight, wherein said hydraulic cylinder is adapted to vary the position of said counterweight with respect to said beam.

9. The counterweighted lifting beam of claim 7, wherein the lifting beam includes a means associated with the counterweight for assisting in the movement of the counterweight.

10. The counterweighted lifting beam of claim 7, further including at least one storage battery to provide power to the counterweight adjustment mechanism.

11. The counterweighted lifting beam of claim 7, wherein the storage unit includes a housing to conceal the components of the counterweight adjustment mechanism.

12. The counterweighted lifting beam of claim 10, further including a recharging apparatus for recharging the said least one storage battery.

13. A lifting beam with an adjustable counterweight for raising a load from a first elevation to a second elevation comprising:

an elongated beam having a first end and a spaced apart second end, the first end adapted to permit securing the load;

the elongated beam including a cavity positioned within the elongated beam;

a counterweight, slidably disposed within the cavity of the elongated beam, the counterweight adapted to offset the weight of the load at the first end of the elongated beam;

a counterweight adjustment mechanism adapted to vary the position of the counterweight within the elongated beam;

a lifting tower rigidly secured at about the center of gravity of the elongated beam, the lifting tower rigidly secured to the top and sides of said elongated beam;

a storage unit positioned adjacent to a side of said lifting tower, opposite said first end of said elongated beam and above said beam, said storage unit adapted to store system components to operate said counterweight positioning mechanism, wherein the positioning of said storage unit and said system components proximate the center of gravity of the elongated beam, concentrates overall lifting beam mass at the midpoint of said beam, increasing overall lifting beam stability.

14. The lifting beam of claim 13, wherein the storage unit includes a protective housing.

15. The lifting beam of claim 13, wherein the counterweight adjustment mechanism includes a hydraulic cylinder connected to the counterweight, wherein the hydraulic cylinder is adapted to vary the position of the counterweight with respect to the elongated beam.

16. The lifting beam of claim 13, wherein the lifting beam includes a means associated with the counterweight and adapted to assist in the positioning of the counterweight.

17. The lifting beam of claim 13, further including at least one storage battery to provide power to the counterweight adjustment mechanism.

18. The lifting beam of claim 14, wherein the protective housing includes a hinge adapted to permit the protective housing to be tilted to an open position.

19. The lifting beam of claim 13, further including a recharging apparatus for recharging the at least one storage battery.

* * * * *